US012150477B2

(12) United States Patent
Kim et al.

(10) Patent No.: US 12,150,477 B2
(45) Date of Patent: Nov. 26, 2024

(54) AEROSOL GENERATING DEVICE

(71) Applicant: KT&G CORPORATION, Daejeon (KR)

(72) Inventors: Dong Sung Kim, Gyeonggi-do (KR); Heon Jun Jeong, Seoul (KR); Won Kyeong Lee, Seoul (KR); Jae Sung Choi, Gyeonggi-do (KR)

(73) Assignee: KT&G CORPORATION, Daejeon (KR)

( * ) Notice: Subject to any disclaimer, the term of this patent is extended or adjusted under 35 U.S.C. 154(b) by 363 days.

(21) Appl. No.: 17/626,395

(22) PCT Filed: Jul. 1, 2021

(86) PCT No.: PCT/KR2021/008374
§ 371 (c)(1),
(2) Date: Jan. 11, 2022

(87) PCT Pub. No.: WO2022/010182
PCT Pub. Date: Jan. 13, 2022

(65) Prior Publication Data

US 2023/0292829 A1 Sep. 21, 2023

(30) Foreign Application Priority Data

Jul. 9, 2020 (KR) ..... 10-2020-0084944

(51) Int. Cl.
*A24F 40/05* (2020.01)
*A24F 40/10* (2020.01)
(Continued)

(52) U.S. Cl.
CPC ..... *A24F 40/05* (2020.01); *A24F 40/10* (2020.01); *A24F 40/20* (2020.01); *A24F 40/30* (2020.01);
(Continued)

(58) Field of Classification Search
CPC ..... A24F 40/05; A24F 40/485; A24F 40/10; A24F 40/46; A24F 40/20; A24F 40/30; A24F 40/42
(Continued)

(56) References Cited

U.S. PATENT DOCUMENTS 6,234,167 B1 5/2001 Cox et al.
9,504,794 B2 * 11/2016 Esaki ..... A61M 11/002
(Continued)

FOREIGN PATENT DOCUMENTS

CA 3 116 153 A1 4/2020
CN 102655773 A 9/2012
(Continued)

OTHER PUBLICATIONS

Office Action dated Jun. 28, 2022, issued in Korean Application No. 10-2020-0084944.
(Continued)

*Primary Examiner* — Peter G Leigh
(74) *Attorney, Agent, or Firm* — Sughrue Mion, PLLC

(57) ABSTRACT

An aerosol generating device includes a storage tank configured to store an aerosol generating material; a compressed air generator configured to generate compressed air; and a nozzle including an inlet end through which compressed air flows in and an outlet end through which the compressed air flows out, wherein the aerosol generating material stored in the storage tank is atomized into an aerosol by colliding with the compressed air discharged from the outlet end of the nozzle.

14 Claims, 6 Drawing Sheets

(51) Int. Cl.

| | |
|---|---|
| ***A24F 40/20*** | (2020.01) |
| ***A24F 40/30*** | (2020.01) |
| ***A24F 40/42*** | (2020.01) |
| ***A24F 40/46*** | (2020.01) |
| ***A24F 40/485*** | (2020.01) |

(52) U.S. Cl.
CPC ..... *A24F 40/42* (2020.01); *A24F 40/46* (2020.01); *A24F 40/485* (2020.01)

(58) Field of Classification Search
USPC ..... 131/329
See application file for complete search history.

(56) References Cited

U.S. PATENT DOCUMENTS

| | | | | |
|---|---|---|---|---|
| 10,137,260 | B2 * | 11/2018 | Tanaka | A61M 11/06 |
| 10,780,237 | B2 | 9/2020 | Suzuki et al. | |
| 2006/0157584 | A1 | 7/2006 | Nomiyama et al. | |
| 2013/0327323 | A1 * | 12/2013 | Rubin | A61M 16/1065 128/200.14 |
| 2014/0053839 | A1 | 2/2014 | Nakamura | |
| 2014/0261401 | A1 * | 9/2014 | Esaki | A61M 11/06 128/200.21 |
| 2016/0044965 | A1 | 2/2016 | Liu | |
| 2016/0143354 | A1 | 5/2016 | Liu | |
| 2016/0198772 | A1 | 7/2016 | Thorens et al. | |
| 2017/0280775 | A1 | 10/2017 | Manca et al. | |
| 2017/0360093 | A1 * | 12/2017 | Fernando | A24F 40/485 |
| 2017/0368273 | A1 * | 12/2017 | Rubin | A61M 16/0093 |
| 2018/0352854 | A1 | 12/2018 | Liu et al. | |
| 2019/0209791 | A1 | 7/2019 | Courbat et al. | |
| 2019/0230991 | A1 | 8/2019 | Liu et al. | |
| 2019/0299230 | A1 | 10/2019 | Song | |
| 2019/0321570 | A1 * | 10/2019 | Rubin | A61M 16/209 |
| 2019/0387793 | A1 | 12/2019 | Angelico et al. | |
| 2020/0038601 | A1 | 2/2020 | Hepworth et al. | |
| 2020/0178606 | A1 | 6/2020 | Liu et al. | |
| 2020/0268055 | A1 | 8/2020 | An | |
| 2021/0146068 | A1 | 5/2021 | Bartels et al. | |
| 2021/0205547 | A1 | 7/2021 | Mazur et al. | |

FOREIGN PATENT DOCUMENTS

| | | | | |
|---|---|---|---|---|
| CN | 103338804 | A | 10/2013 | |
| CN | 108697867 | A | 10/2018 | |
| CN | 110769942 | A | 2/2020 | |
| CN | 111182802 | A | 5/2020 | |
| JP | 2007-195838 | A | 8/2007 | |
| JP | 3957373 | B2 | 8/2007 | |
| JP | 2013-132472 | A | 7/2013 | |
| JP | 2019-176855 | A | 10/2019 | |
| JP | 2019-530457 | A | 10/2019 | |
| KR | 10-2001-0080091 | A | 8/2001 | |
| KR | 10-1011453 | B1 | 1/2011 | |
| KR | 10-2017-0094150 | A | 8/2017 | |
| KR | 10-2019-0047110 | A | 5/2019 | |
| WO | WO-2011135914 | A1 * | 11/2011 | A61M 11/06 |
| WO | WO-2011158716 | A1 * | 12/2011 | A61M 11/06 |
| WO | 2013/065776 | A1 | 5/2013 | |
| WO | 2016/026156 | A1 | 2/2016 | |
| WO | 2016/096497 | A1 | 6/2016 | |
| WO | 2018/058884 | A1 | 4/2018 | |
| WO | 2019/037765 | A1 | 2/2019 | |

OTHER PUBLICATIONS

Extended European Search Report dated Jul. 21, 2022, issued in European Application No. 21836941.1.
Written Opinion of PCT/KR2021/008374 dated Oct. 8, 2021 [PCT/ISA/237].
International Search Report of PCT/KR2021/008374 dated Oct. 8, 2021 [PCT/ISA/210].
Chinese Office Action dated Mar. 31, 2023 in Chinese Application No. 202180005579.9.
Japanese Office Action dated Apr. 4, 2023 in Japanese Application No. 2022-508592.

* cited by examiner

[Fig. 1]
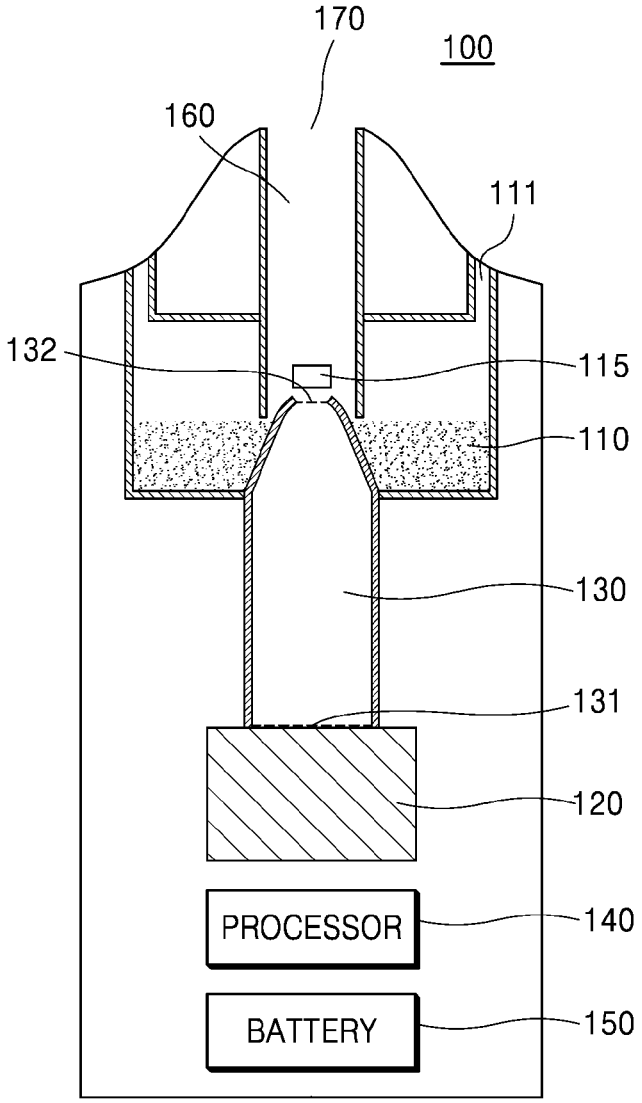

[Fig. 2]
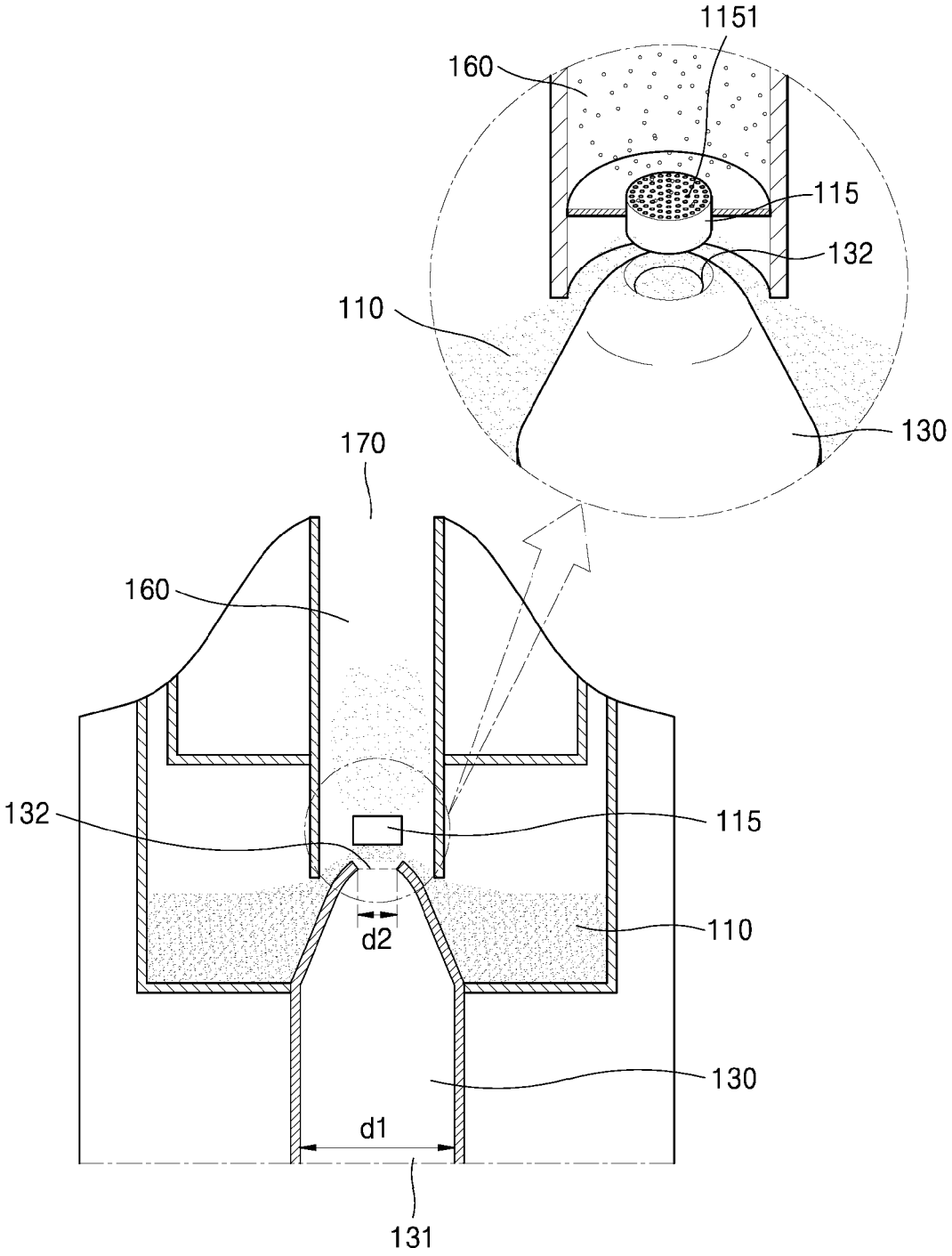

[Fig. 3]
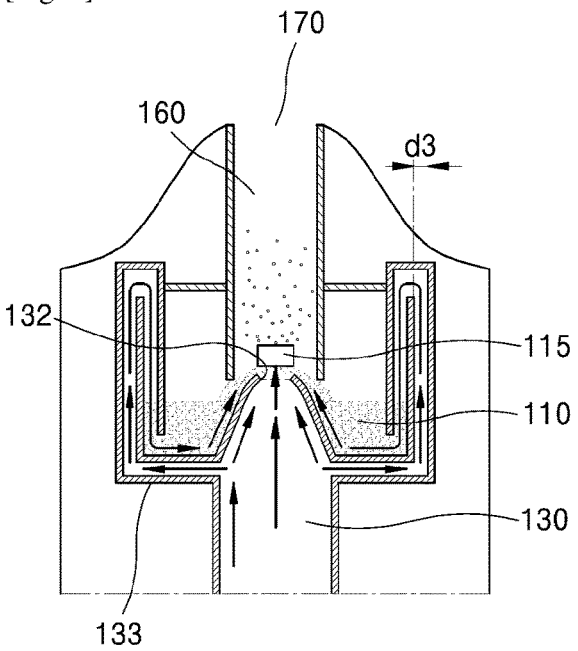
[Fig. 4A]
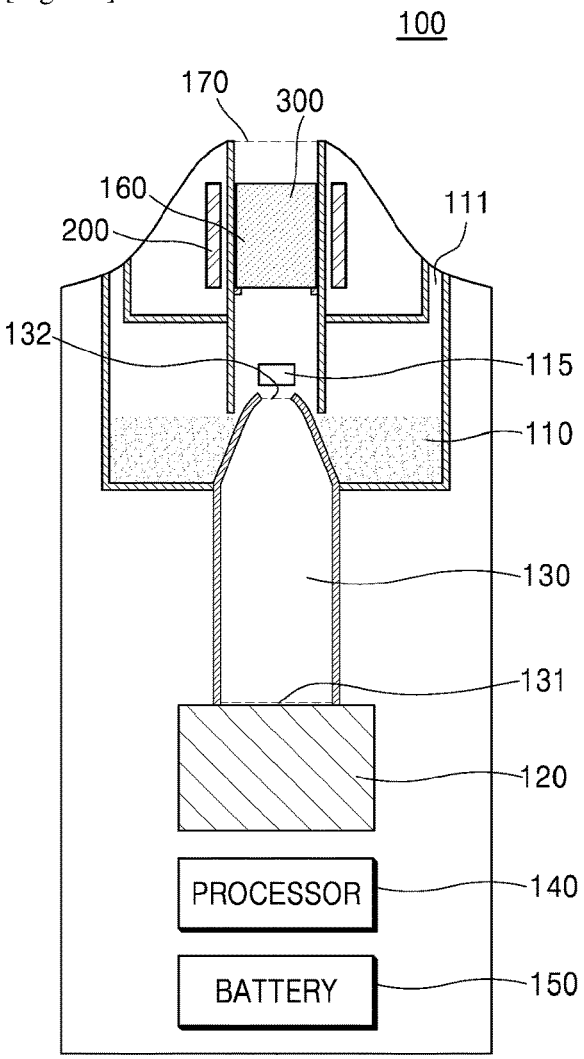

[Fig. 4B]
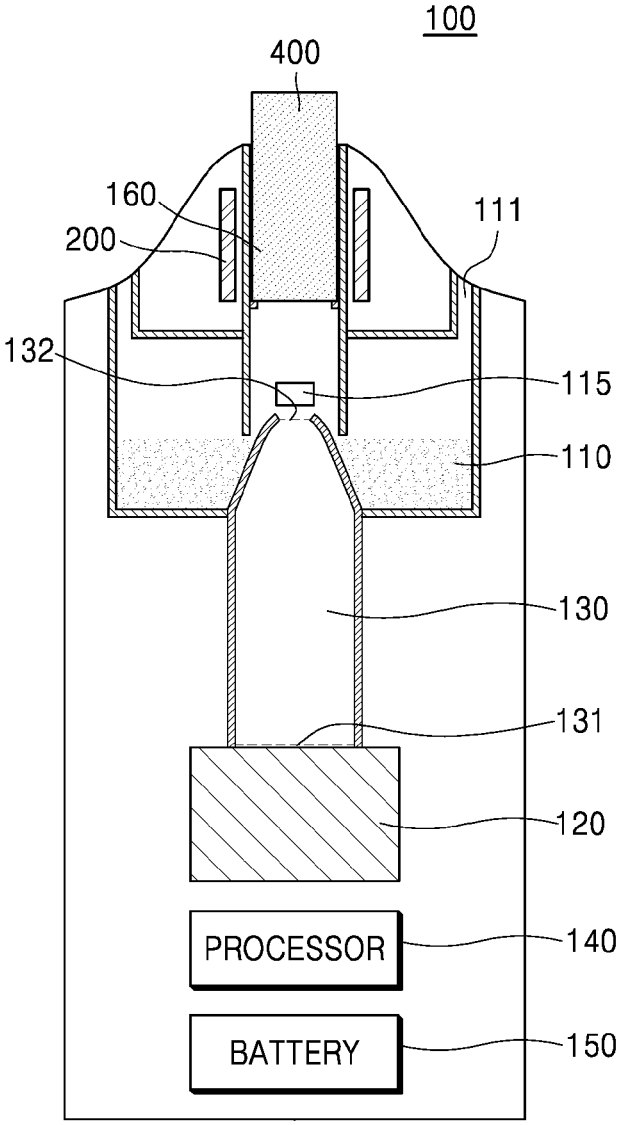

[Fig. 5]
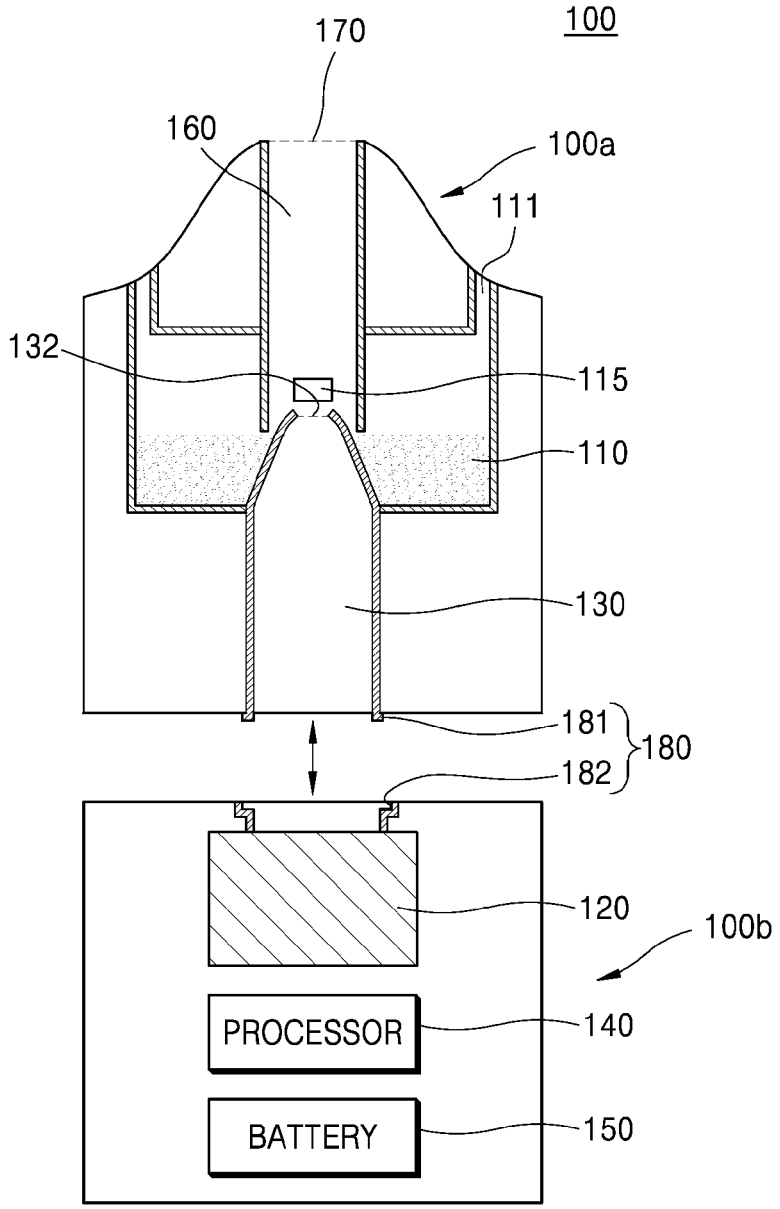

[Fig. 6]
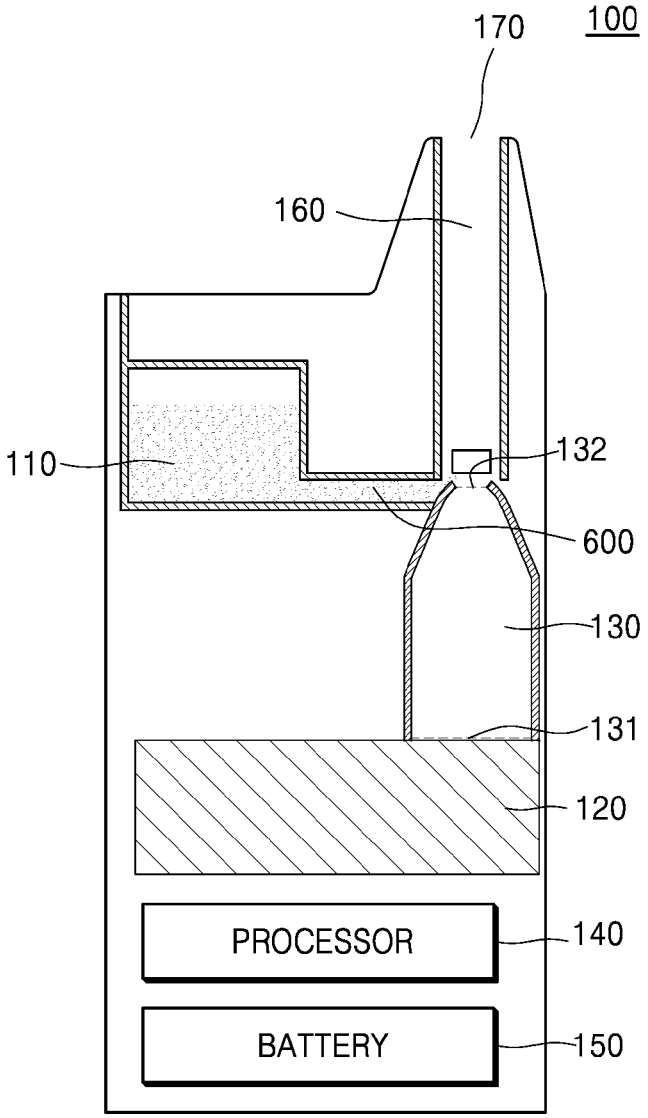

AEROSOL GENERATING DEVICE

CROSS REFERENCE TO RELATED APPLICATIONS

This application is a National Stage of International Application No. PCT/KR2021/008374, filed Jul. 1, 2021, claiming priority to Korean Patent Application No. 10-2020-0084944, filed Jul. 9, 2020.

TECHNICAL FIELD

The embodiments relate to an aerosol generating device, and more particularly, to an aerosol generating device for atomizing an aerosol generating material into an aerosol by spraying compressed air.

BACKGROUND ART

Recently, the demand for an alternative traditional cigarettes has increased. For example, there is growing demand for an aerosol generating device that generates an aerosol by heating or atomizing an aerosol generating material in a cigarette or a cartridge, instead of combusting a cigarette.

DISCLOSURE OF INVENTION

Technical Problem

There is a need for an aerosol generating device that generates an aerosol without combustion of a cigarette.

The embodiments provide an aerosol generating device for atomizing an aerosol generating material into an aerosol by spraying compressed air.

Technical problems to be solved by the embodiments are not limited to the above-described problems, and problems that are not mentioned will be clearly understood by those of ordinary skill in the art from the present disclosure and the accompanying drawings.

Solution to Problem

When an aerosol generating material collides with an object with kinetic energy, the aerosol generating material may be atomized into an aerosol. A certain object may include, for example, air that is discharged at a high speed. Air may be compressed to form compressed air. Compressed air may be discharged toward an aerosol generating material to impact the aerosol generating material. An aerosol generating material may be atomized into an aerosol to be inhaled by a user.

An aerosol generating device according to an aspect includes a storage tank configured to store an aerosol generating material; a compressed air generator configured to generate compressed air; and a nozzle including an inlet end through which compressed air flows in and an outlet end through which the compressed air flows out, wherein the aerosol generating material stored in the storage tank is atomized into an aerosol by colliding with the compressed air discharged from the outlet end of the nozzle.

Advantageous Effects of Invention

An aerosol generating device according to embodiments may atomize an aerosol generating material into an aerosol by spraying compressed air. The type of aerosol generating material that may be atomized is not limited to properties of the aerosol generating material and may be various. Accordingly, users may inhale aerosols of more various flavors according to the user's preference.

Embodiments may move an aerosol generating material to a certain position by using a negative pressure operation. As an aerosol generating material moves to a certain position, an internal structure of the aerosol generating device may be easily changed and simplified.

BRIEF DESCRIPTION OF DRAWINGS

FIG. 1 is a cross-sectional view of an aerosol generating device according to an embodiment;

FIG. 2 is an enlarged view of part of the aerosol generating device shown in FIG. 1;

FIG. 3 is a cross-sectional view of part of an aerosol generating device including an extension flow path according to another embodiment;

FIG. 4A is a cross-sectional view of an aerosol generating device including a flavor element according to an embodiment;

FIG. 4B is a cross-sectional view of an aerosol generating device including a flavor element according to another embodiment;

FIG. 5 is a cross-sectional view of an aerosol generating device including a cartridge according to an embodiment; and FIG. 6 is a cross-sectional view of an aerosol generating device including an extension pipe according to another embodiment.

BEST MODE FOR CARRYING OUT THE INVENTION

An aerosol generating device according to an aspect includes a storage tank configured to store an aerosol generating material; a compressed air generator configured to generate compressed air; and a nozzle including an inlet end through which compressed air flows in and an outlet end through which the compressed air flows out, wherein the aerosol generating material stored in the storage tank is atomized into an aerosol by colliding with the compressed air discharged from the outlet end of the nozzle.

In addition, the storage tank may include an inlet passage which is in fluid communication with an outside of the aerosol generating device.

In addition, a diameter of the inlet end may be greater than a diameter of the outlet end.

In addition, the diameter of the inlet end may be 2 to 12 times greater than the diameter of the outlet end.

In addition, the aerosol generating device may further include a pulverizer arranged adjacent to the outlet end and configured to atomize an aerosol.

In addition, the pulverizer may include a plurality of through-holes such that the aerosol passes through the plurality of through-holes.

In addition, the aerosol generating device may further include an extension flow path extending from the nozzle and surrounding at least part of the storage tank, and the extension flow path may pressurize the aerosol generating material in the storage tank by discharging the compressed air.

In addition, the extension flow path may include a portion extending from an upper portion of the storage tank to a lower portion of the storage tank such that the compressed air discharged from the extension flow path may pressurize the aerosol generating material toward the outlet end.

In addition, the aerosol generating device may further include an airflow path through which the atomized aerosol flows, and a heater located in the airflow path.

In addition, the heater may surround the airflow path such that heat from the heater is transferred to the aerosol flowing through the airflow path.

In addition, the aerosol generating device may further include a flavor element provided in the airflow path and configured to add flavor to the aerosol flowing through the airflow path.

In addition, the flavor element may be exposed to an outside of the airflow path and configured to contact a user's mouth.

In addition, a cartridge including the storage tank and the nozzle may be detachably combined with a main body including the compressed air generator.

In addition, the cartridge and the main body may be coupled to each other by a first packing structure formed in the cartridge and a second packing structure formed in the main body.

In addition, the aerosol generating device may further include an extension pipe extending from the storage tank toward the outlet end, and an aerosol generating material flowing through the extension pipe may be atomized into the aerosol by colliding with the compressed air discharged from the outlet end of the nozzle.

MODE FOR THE INVENTION

With respect to the terms used to describe in the various embodiments, the general terms which are currently and widely used are selected in consideration of functions of structural elements in the various embodiments of the present disclosure. However, meanings of the terms can be changed according to intention, a judicial precedence, the appearance of a new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and operation and can be implemented by hardware components or software components and combinations thereof.

As used herein, expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

Throughout the specification, "embodiments" are provided to easily describe the present disclosure in the present specification, and each of the embodiments need not be mutually exclusive. For example, configurations disclosed in one embodiment may be applied to and implemented in other embodiments and may be changed and applied and implemented without departing from the idea and scope of the present specification.

In addition, terms used in the present specification are for describing the embodiments and are not intended to limit the embodiments. In the present specification, a singular form also includes plural forms unless specifically stated in the phrase.

Throughout the specification, a "lengthwise direction" of a component may be a direction parallel to one axis of the component along which the component extends longer than it extends along other axes crossing the one axis.

FIG. 1 is a cross-sectional view of an aerosol generating device 100 according to an embodiment.

The aerosol generating device 100 according to an embodiment may include a storage tank 110 that stores an aerosol generating material.

The aerosol generating material may be a liquid composition. The liquid composition may include at least one of nicotine, propylene glycol (PG), and glycerin (Gl). The nicotine may be obtained from a tobacco leaf. In addition, the nicotine may be naturally generated nicotine or synthetic nicotine. For example, the nicotine may include free base nicotine and/or nicotine salt.

The liquid composition may include nicotine or a nicotine salt. Nicotine salts may be formed by adding suitable acids, including organic or inorganic acids, to nicotine. Nicotine may be a naturally generated nicotine or synthetic nicotine and may have any suitable weight concentration relative to the total solution weight of the liquid composition.

Acid for the formation of the nicotine salts may be appropriately selected in consideration of the rate of nicotine absorption in the blood, the operating temperature of the aerosol generating apparatus 100, the flavor or savor, the solubility, or the like. For example, the acid for the formation of nicotine salts may be a single acid selected from the group consisting of benzoic acid, lactic acid, salicylic acid, lauric acid, sorbic acid, levulinic acid, pyruvic acid, formic acid, acetic acid, propionic acid, butyric acid, valeric acid, caproic acid, caprylic acid, capric acid, citric acid, myristic acid, palmitic acid, stearic acid, oleic acid, linoleic acid, linolenic acid, phenylacetic acid, tartaric acid, succinic acid, fumaric acid, gluconic acid, saccharic acid, malonic acid or malic acid, or a mixture of two or more acids selected from the group, but is not limited thereto.

Propylene glycol and glycerin contained in the liquid composition are aerosol formers, and an aerosol may be generated when the propylene glycol and glycerin are atomized. For example, the liquid composition may include any weight ratio of glycerin and propylene glycol solution to which nicotine salts are added.

The liquid composition may include, for example, any one component of water, solvents, ethanol, plant extracts, spices, flavorings, and vitamin mixtures, or a mixture thereof. The spices may include menthol, peppermint, spearmint oil, and various fruit-flavored ingredients, but are not limited thereto. The flavorings may include ingredients capable of providing various flavors or tastes to a user. Vitamin mixtures may be a mixture of at least one of vitamin A, vitamin B, vitamin C, and vitamin E, but are not limited thereto.

The storage tank 110 may include an inlet passage 111 which is in fluid communication with the outside of the aerosol generating device 100. External air may flow in the storage tank 110 through the inlet passage 111. For example, when a pressure of the storage tank 110 decreases, external air may flow in the storage tank 110. A membrane (not shown) may be arranged in the inlet passage 111 to prevent an aerosol generating material stored in the storage tank 110 from flowing out of the storage tank 110.

The aerosol generating device 100 according to the embodiment may include a compressed air generator 120 that generates compressed air. The compressed air generator 120 may compress air so that the air move at a high speed. For example, the compressed air generator 120 may include a compressor.

When the compressed air generator 120 is implemented by a compressor, the compressor may be electrically connected to a battery 150. The compressor may receive power from the battery 150 and change the pressure and the speed of a gas. The compressor may generate compressed air by compressing external air flowing in. The compressed air generated by the compressor may move faster, and the compressed air with an increased speed may be discharged from the compressor.

According to another embodiment, the compressed air generator 120 may include a pump. The pump may generate compressed air by an action of a user.

For example, the user may cause the pump to perform a repetitive piston operation. The pump may generate the compressed air by compressing external air according to the piston operation.

As another example, the user may operate the pump by twisting the aerosol generating device 100. While holding the aerosol generating device 100 including the pump, the user may twist one portion of the aerosol generating device 100 with respect to the other portion. The pump may operate due to the twisting and generate the compressed air by compressing external air.

As another example, the pump may operate due to vibrational motion. The vibrational motion of the pump may be caused by the user. In addition, the vibrational motion of the pump may be automatically performed as the user moves with the aerosol generating device 100. The pump may operate due to the vibrational motion, and the pump may generate compressed air by compressing external air. The compressed air generated by the pump may be accelerated, and the compressed air with an increased speed may be discharged from the pump. The user action for operating the pump is not limited to the above-described example and may be changed as necessary.

The aerosol generating device 100 according to one embodiment may include a nozzle 130 including an inlet end 131 through which compressed air flows in and an outlet end 132 though which compressed air flows out. In addition, the aerosol generating device 100 may include a pulverizer 115 arranged close to the outlet end 132 to atomize an aerosol.

The aerosol generating material stored in the storage tank 110 may be atomized after colliding with the compressed air discharged from the outlet end 132 of the nozzle 130. The atomization of the aerosol generating material will be described in more detail below with reference to FIG. 2.

The aerosol generating device 100 according to one embodiment may include the battery 150 and a processor 140.

The battery 150 supplies power to be used for the aerosol generating device 100 to operate. The battery 150 may be electrically connected to the compressed air generator 120 to supply power to the compressed air generator 120. In addition, the battery 150 may supply power required for operation of other hardware components included in the aerosol generating device 100 The battery 150 may be a rechargeable battery or a disposable battery. For example, the battery 150 may be a lithium polymer (LiPoly) battery, but it is not limited thereto.

The processor 140 may generally control operations of the aerosol generating device 100. The processor 140 may be electrically connected to the compressed air generator 120 to turn on or off the compressed air generator 120. The processor 140 may include a plurality of processors 140. Also, the processor 140 may include an array of a plurality of logic gates.

A processor can be implemented as an array of a plurality of logic gates or can be implemented as a combination of a general-purpose microprocessor and a memory in which a program executable in the microprocessor is stored. It will be understood by one of ordinary skill in the art that the processor can be implemented in other forms of hardware.

FIG. 2 is an enlarged view of part of the aerosol generating device 100 shown in FIG. 1.

Atomization of the aerosol generating material will be described in more detail with reference to FIG. 2.

The nozzle 130 of the aerosol generating device 100 according to one embodiment may include the inlet end 131 through which compressed air flows into the nozzle 130. To this end, the inlet end 131 may be in fluid communication with the compressed air generator 120. The compressed air flowing into the inlet end 131 may flow out through the outlet end 132 of the nozzle 130.

The diameter d1 of the inlet end 131 of the nozzle 130 may be greater than the diameter d2 of the outlet end 132. For example, the diameter d1 of the inlet end 131 may be 2 to 12 times greater than the diameter d2 of the outlet end 132.

When the diameter of the inlet end 131 is greater than the diameter of the outlet end 132, a speed of compressed air flowing into the inlet end 131 and flowing out from the outlet end 132 may be increased. When the compressed air passes through the outlet end 132, a speed of the compressed air may increase according to Bernoulli's principle. As the speed of the compressed air increases, momentum of the compressed air colliding with the aerosol generating material may increase. As the momentum of the compressed air increases, the aerosol generating material may be more effectively atomized into an aerosol.

As the speed of the compressed air flowing out from the outlet end 132 increases, a pressure of a region near the outlet end 132 may be reduced. As the pressure of the region near the outlet end 132 is reduced, the aerosol generating material may be attracted to the region near the outlet end 132 according to a negative pressure operation (i.e., by the reduced pressure), and collide with the compressed air having an increased speed. As a result, the aerosol generating material may be atomized into an aerosol.

The aerosol generating device 100 may include the pulverizer 115 arranged adjacent to the outlet end 132. An aerosol generated from the aerosol generating material colliding with the compressed air may be pulverized and dispersed by the pulverizer 115 to be further atomized. That is, a particle size of the aerosol may be reduced by the pulverizer 115.

The pulverizer 115 may include a plurality of through-holes 1151. The plurality of through-holes 1151 may be formed to extend from one surface of the pulverizer 115 to the other surface the pulverizer 115. Here, one surface of the pulverizer 115 may face the outlet end 132 of the nozzle 130, and the other surface of the pulverizer 115 may face the opposite direction. The pulverizer 115 may be spaced apart from the nozzle 130 by a certain distance in a lengthwise direction of the nozzle 130.

The generated aerosol may pass through the through-hole 1151 formed in the pulverizer 115. The aerosol passing through the through-hole 1151 may be further atomized to smaller particles and flow in the airflow path 160.

The aerosol flowing through the airflow path 160 may move toward a mouthpiece 170. The mouthpiece 170 of the aerosol generating device 100 may be a portion coming into contact with a user's mouth. A user may inhale an aerosol by making his/her mouth come into contact with the mouthpiece 170. An inhalation unit may be additionally provided between the user's mouth and the mouthpiece 170. The user may inhale the aerosol through the inhalation unit instead of making his/her mouth come into direct contact therewith.

In the aerosol generating device 100 according to one embodiment, an aerosol may be provided according to the following process. The aerosol generating material may be attracted to a region near the outlet end 132 of the nozzle 130 by a negative pressure operation. The aerosol generating material attracted to the region near the outlet end 132 may collide with compressed air of a high speed to be atomized into an aerosol. The atomized aerosol may pass through the through-hole 1151 formed in the pulverizer 115. The aerosol may be pulverized and dispersed by the pulverizer 115 to be further atomized, and a particle size of the aerosol may be reduced. The aerosol may flow toward the mouthpiece 170 through the airflow path 160. A user may inhale the aerosol moved to the mouthpiece 170 by making his/her mouth come into contact with the mouthpiece 170.

Hereinafter, components having the same reference numerals as the components of the embodiment shown in FIGS. 1 and 2 may indicate substantially the same components, and components related to one embodiment may be applied to other embodiments in substantially the same manner.

FIG. 3 is an enlarged cross-sectional view of part of an aerosol generating device 100 according to another embodiment.

The aerosol generating device according to this embodiment may include an extension flow path 133 that extends from the nozzle 130 and surrounds at least part of the storage tank 110, in addition to the configuration of the aerosol generating device 100 according to the embodiment of FIGS. 1 and 2.

The extension flow path 133 may extend from the nozzle 130 and surround part of the storage tank 110. For example, as shown in FIG. 3, the extension flow path 133 may surround a lower portion and a side portion of the storage tank 110, and further extend from an upper portion of the storage tank 110 to the lower portion of the storage tank 110. The diameter d3 of the extension flow path 133 may be less than the diameter d1 of the inlet end 131.

A direction of the compressed air discharged from the extension flow path 133 may be a direction in which the extension flow path 133 extends. For example, as shown in FIG. 3, the extension flow path 133 may include a portion extending from an upper portion to a lower portion of the storage tank 110 and may have an outlet at the end of the portion. In this case, the compressed air may be discharged from the extension flow path 133 in a downward direction from the upper portion of the storage tank 110 toward the lower portion of the storage tank 110.

As another example, the extension flow path 133 may be in contact with a bottom surface of the storage tank 110 and have a portion extending toward a central axis of the storage tank 110, and an outlet may be formed at an end of the portion. In this case, the compressed air discharged from the extension flow path 133 may flow along the bottom surface of the storage tank 110 toward a central axis of the storage tank 110.

The compressed air passing through the extension flow path 133 may be discharged through the outlet of the extension flow path 133. The compressed air discharged from the extension flow path 133 may pressurize the aerosol generating material so that the aerosol generating material in the storage tank 110 move toward the outlet end 132.

The compressed air discharged from the extension flow path 133 may pressurize the aerosol generating material in a direction in which the compressed air is discharged. For example, the compressed air may be discharged in a direction from the upper portion of the storage tank 110 toward the lower portion of the storage tank 110. When compressed air is discharged in a direction from the upper portion of the storage tank 110 to the lower portion of the storage tank 110, the aerosol generating material may be pressurized in a direction from the upper portion of the storage tank 110 to the lower portion of the storage tank 110 (i.e., in a downward direction). As the aerosol generating material is pressurized, the aerosol generating material may move toward the outlet end 132 of the nozzle 130.

Therefore, the aerosol generating material may be attracted to a region near the outlet end 132 of the nozzle 130 by the compressed air discharged from the extension flow path 133, in addition to the aforementioned negative pressure operation. The aerosol generating material attracted to a region near the outlet end 132 may collide with the compressed air of a high speed which passes through the outlet end 132 and may be atomized into an aerosol. The atomized aerosol may pass through the airflow path 160 and may be inhaled by the user through the mouthpiece 170.

FIG. 4A is a cross-sectional view of an aerosol generating device 100 including a flavor element according to an embodiment, and FIG. 4B is a cross-sectional view of an aerosol generating device 100 including a flavor element according to another embodiment.

The aerosol generating device 100 according to another embodiment may include a heater 200 on an airflow path 160. The heater 200 may surround the airflow path 160 such that heat from the heater 200 may be transferred to an aerosol flowing in the airflow path 160. A temperature of the aerosol may increase due to heat from the heater 200, and the aerosol may be atomized by the heat from the heater 200. The temperature and a degree of atomization of the aerosol may be suitable for a user to inhale the aerosol.

The heater 200 may be formed of any suitable electrically resistive material. For example, the suitable electrically resistive material may be a metal or a metal alloy including titanium, zirconium, tantalum, platinum, nickel, cobalt, chromium, hafnium, niobium, molybdenum, tungsten, tin, gallium, manganese, iron, copper, stainless steel, or nichrome, but is not limited thereto. In addition, the heater 200 may be implemented by a metal wire, a metal plate on which an electrically conductive track is arranged, or a ceramic heating element, but is not limited thereto.

The heater 200 may be an induction heating type heater 200. The heater 200 may include an electrically conductive coil for heating a cigarette or a cartridge 100*a* (see FIG. 5) by using an induction heating method, and the cigarette or the cartridge 100*a* may include a susceptor that may be heated by the induction heating type heater 200.

The aerosol generating device 100 according to the embodiments of FIGS. 4A and 4B may include a flavor element for adding flavor to an aerosol flowing through the airflow path 160.

Flavor elements 300 and 400 and the airflow path 160 may have shapes corresponding to each other. For example, when the flavor elements 300 and 400 and the airflow path 160 may have a cylindrical shape so that the airflow path 160 may accommodate the flavor element 300 and 400. However, the shapes of the flavor elements 300 and 400 and the airflow path 160 are not limited thereto and may be changed as necessary.

In order for a user to inhale an aerosol, the flavor elements 300 and 400 may impart flavor to the aerosol passing through the airflow path 160, and the aerosol may entrain the flavor discharged from the flavor elements 300 and 400. The flavor elements 300 and 400 may include fragrance such as tobacco, aroma or nicotine content. The fragrance may include menthol, peppermint, spearmint oil, or various fruit flavor ingredients but is not limited thereto.

For example, flavor elements 300 and 400 may be provided in the form of a cigarette including granules. The granules of the flavor elements 300 and 400 may include nicotine content. When the nicotine content is included in the granules of the flavor elements 300 and 400, the aerosol generating material in the storage tank 110 may not include the nicotine content and may include only aerosol forming agents such as propylene glycol and glycerin.

As shown in FIG. 4A, the flavor element 300 may be fully inserted into the airflow path 160. Flavor element 300 may be provided in the airflow path 160. The flavor element 300 may be inserted into the airflow path 160 by a user and may be removed after being used.

The flavor element 300 may be located in the airflow path 160 to correspond to a position of the heater 200. The flavor element 300 may discharge flavor by heat transferred from the heater 200. The flavor discharged from the flavor element 300 may be added to the aerosol flowing through the airflow path 160.

As shown in FIG. 4B, at least a part of the flavor element 400 may protrude from the airflow path 160 to be exposed to the outside of the airflow path 160. In this case, the flavor element 400 may be a mouthpiece 170 coming into contact with a user's mouth. The flavor element 400 may include one end inserted into the airflow path 160 and the other end protruding from the airflow path 160. The other end of the flavor element 400 may come into contact with the user's mouth.

The user may be in contact with the flavor element 400 to inhale an aerosol passing through the flavor element 400. In this case, the aerosol passing through the flavor element 400 may include flavor emitted from the flavor element 400.

FIG. 5 is a cross-sectional view of an aerosol generating device 100 including a cartridge according to an embodiment.

The aerosol generating device 100 according to the present embodiment may include a cartridge 100*a* and a main body 100*b*. The cartridge 100*a* may include a storage tank 110 and a nozzle 130, and a main body 100*b* may include a compressed air generator 120.

The cartridge 100*a* may further include a pulverizer 115 and an airflow path 160 in addition to the storage tank 110 and the nozzle 130, but components that may be further included in the cartridge 100*a* are not limited thereto and may be changed as necessary. The main body 100*b* may further include a processor 140 and a battery 150 in addition to the compressed air generator 120, but components that may be included in the main body 100*b* are not limited thereto and may be changed as necessary.

The cartridge 100*a* may be detachably combined with the main body 100*b*. When the aerosol generating material stored in the storage tank 110 of the cartridge 100*a* is exhausted, a user may replace the cartridge 100*a*. The cartridge 100*a* and the main body 100*b* may be combined by using a packing structure 180.

A first packing structure 181 may be formed in the cartridge 100*a*. A second packing structure 182 may be formed in the main body 100*b*. The cartridge 100*a* and the body 100*b* may be combined by using the first packing structure 181 and the second packing structure 182.

The first packing structure 181 and the second packing structure 182 may have shapes corresponding to each other. The first packing structure 181 and the second packing structure 182 may be hermetically attached to each other. By using the first packing structure 181 and the second packing structure 182, the compressed air discharged from the compressed air generator 120 may flow inside the nozzle 130 without leaking to the outside.

For example, the first packing structure 181 may be a protrusion, and the second packing structure 182 may be a groove into which the protrusion is inserted. In this case, the protrusion may have a shape corresponding to the groove such that the first packing structure 181 (i.e., a protrusion) may be inserted into the second packing structure 182 (i.e., a groove). For example, the first packing structure 181 may be inserted in the second packing structure 182 by an interference fit.

As another example, the first packing structure 181 may be a ring portion, and the second packing structure 182 may be an accommodation portion that accommodates the ring portion. The first packing structure 181 which is a ring portion may be fastened to the second packing structure 182 which is an accommodation portion. The first packing structure 181 may be fitted and fastened to the second packing structure 182. The first packing structure 181 which is a ring portion and the second packing structure 182 which is an accommodation portion may hermetically couple the cartridge 100*a* and the main body 100*b* to each other.

The first packing structure 181 and the second packing structure 182 may have flexibility. The first packing structure 181 and the second packing structure 182 may include a flexible material such as rubber.

As long as the first packing structure 181 and the second packing structure 182 hermetically couple the cartridge 100*a* and the body 100*b* to each other, shapes and materials of the first packing structure 181 and the second packing structure of 182 are not limited to the above-described example.

FIG. 6 is a cross-sectional view of an aerosol generating device 100 according to another embodiment.

The aerosol generating device 100 according to the present embodiment may include an extension pipe 600 extending from a storage tank 110 toward an outlet end 132. The extension pipe 600 may be connected to the lower portion of the storage tank 110 such that the aerosol generating material stored in the storage tank 110 may flow through the extension pipe 600.

The aerosol generating material flowing through the extension pipe 600 may flow to the outlet end 132 of the nozzle 130 according to an arrangement of the extension pipe 600. In addition, the aerosol generating material may be attracted to a region near the outlet end 132 of the nozzle 130 by a negative pressure operation. The aerosol generating material attracted to the region near the outlet end 132 collides with compressed air of a high speed passing through the outlet end 132 and may be atomized into an aerosol. The aerosol may flow toward a mouthpiece 170 by flowing through the airflow path 160. A user may inhale the aerosol through the mouthpiece 170.

According to the embodiments, the aerosol generating device 100 may atomize an aerosol generating material into an aerosol by spraying compressed air. The type of aerosol generating material that may be atomized is not limited by properties of the aerosol generating material and may be various. Accordingly, users may inhale aerosols of various flavors according to the user's preference.

According to the embodiments, an aerosol generating material may be moved to a certain position by a negative pressure operation. Accordingly, an internal structure of the aerosol generating device 100 may be easily changed and simplified.

Those of ordinary skill in the art related to the present embodiments may understand that various changes in form and details can be made therein without departing from the scope of the characteristics described above. Therefore, the disclosed methods should be considered in a descriptive point of view, not a restrictive point of view. The scope of the present disclosure is defined by the appended claims rather than by the foregoing description, and all differences within the scope of equivalents thereof should be construed as being included in the present disclosure.

The invention claimed is:

1. An aerosol generating device comprising:

a storage tank configured to store an aerosol generating material;

a compressed air generator configured to generate compressed air;

a nozzle including an inlet end through which compressed air flows in and an outlet end through which the compressed air flows out; and an extension flow path extending from the nozzle and surrounding at least part of the storage tank, wherein the aerosol generating material stored in the storage tank is atomized into an aerosol by colliding with the compressed air discharged from the outlet end of the nozzle, and wherein the extension flow path pressurizes the aerosol generating material in the storage tank by discharging the compressed air.

2. The aerosol generating device of claim 1, wherein the storage tank includes an inlet passage which is in fluid communication with an outside of the aerosol generating device.

3. The aerosol generating device of claim 1, wherein a diameter of the inlet end is greater than a diameter of the outlet end.

4. The aerosol generating device of claim 3, wherein the diameter of the inlet end is 2 to 12 times greater than the diameter of the outlet end.

5. The aerosol generating device of claim 1, further comprising a pulverizer arranged adjacent to the outlet end and configured to atomize an aerosol.

6. The aerosol generating device of claim 5, wherein the pulverizer includes a plurality of through-holes such that the aerosol passes through the plurality of through-holes.

7. The aerosol generating device of claim 1, wherein the extension flow path includes a portion extending from an upper portion of the storage tank to a lower portion of the storage tank such that the compressed air discharged from the extension flow path pressurizes the aerosol generating material toward the outlet end.

8. The aerosol generating device of claim 1, further comprising:

an airflow path through which the aerosol flows; and a heater located in the airflow path.

9. The aerosol generating device of claim 8, wherein the heater surrounds the airflow path such that heat from the heater is transferred to the aerosol flowing through the airflow path.

10. The aerosol generating device of claim 8, further comprising a flavor element provided in the airflow path and configured to add flavor to the aerosol flowing through the airflow path.

11. The aerosol generating device of claim 10, wherein the flavor element is exposed to an outside of the airflow path and configured to contact a user's mouth.

12. The aerosol generating device of claim 1, wherein a cartridge including the storage tank and the nozzle is detachably combined with a main body including the compressed air generator.

13. The aerosol generating device of claim 12, wherein the cartridge and the main body are coupled to each other by a first packing structure formed in the cartridge and a second packing structure formed in the main body.

14. The aerosol generating device of claim 1, further comprising an extension pipe extending from the storage tank toward the outlet end, wherein an aerosol generating material flowing through the extension pipe is atomized into the aerosol by colliding with the compressed air discharged from the outlet end of the nozzle.

* * * * *